United States Patent [19]

Saliger

[11] Patent Number: 4,544,036

[45] Date of Patent: Oct. 1, 1985

[54] VERTICAL FLOWLINE CONNECTOR

[75] Inventor: Kenneth C. Saliger, DeSoto, Tex.

[73] Assignee: Mobil Oil Corporation, New York, N.Y.

[21] Appl. No.: 581,449

[22] Filed: Feb. 17, 1984

[51] Int. Cl.[4] ..... E21B 43/013

[52] U.S. Cl. ..... 166/341; 166/343; 166/344; 285/24; 285/137 A; 405/169

[58] Field of Search ..... 166/341, 343, 346, 347, 166/342, 344, 338, 345; 285/24–29, 137 R, 137 A, 158; 405/169, 168

[56] References Cited

U.S. PATENT DOCUMENTS

| | | | |
|---|---|---|---|
| 785,420 | 3/1905 | Grigsby | 285/27 |
| 3,189,098 | 6/1965 | Haeber | 285/137 A |
| 3,308,881 | 3/1967 | Chan et al. | 166/343 |
| 3,316,984 | 5/1967 | Jones | 166/341 |
| 3,353,595 | 11/1967 | Nelson et al. | 166/347 |
| 3,448,799 | 6/1969 | Ahlstone | 166/346 |
| 3,766,743 | 10/1973 | Brown | 405/169 |
| 3,775,986 | 12/1973 | Daughtry | 166/343 |
| 4,236,577 | 12/1980 | Newdeck | 285/137 R |

FOREIGN PATENT DOCUMENTS

| | | | |
|---|---|---|---|
| 2002078 | 2/1979 | United Kingdom | 285/27 |

*Primary Examiner*—James A. Leppink
*Assistant Examiner*—Hoang C. Dang
*Attorney, Agent, or Firm*—Alexander J. McKillop; Michael G. Gilman; Charles J. Speciale

[57] ABSTRACT

Several embodiments are disclosed of a vertical type of flowline connector for providing a fluid connection between a horizontal flowline and an additional subsea facility. The upper and lower portions of the connector can be properly positioned relative to each other by simply lowering an upper female portion of the connector onto a lower male portion thereof. The lower portion of the connector at the subsea facility is provided with at least two vertically positioned, upwardly facing male mandrel connectors. The upper portion of the connector assembly includes at least two vertically positioned, downwardly facing corresponding female connectors designed to be lowered onto the corresponding male mandrel connectors. At least one of the female connectors is mounted on the connector assembly by a free floating mounting. The free floating mounting allows for slight misalignments of the female connectors relative to the corresponding male connectors as the upper connector assembly is lowered onto, and passively positioned relative to, the lower connector assembly.

16 Claims, 7 Drawing Figures

VERTICAL FLOWLINE CONNECTOR

BACKGROUND OF THE INVENTION

1. Field of the Invention

The present invention relates generally to subsea vertical flowline connector, and more particularly pertains to a remote subsea flowline connector which is suitable for the remote connection of a subsea, generally horizontal flowline to a related subsea facility, such as a second flowline or a subsea atmospheric system or a production well such as a satellite well.

The growing worldwide need for energy has expanded the search for oil and gas on the ocean floor to greater depths. At the present time it is contemplated locating oil and gas wells at ocean depths that only a few years ago were considered to be relatively inaccessible. Accordingly, underwater flowline installations and related equipment have been designed to enable workmen, operating from a floating vessel or the like which is remote from the flowline or wellhead, to simply and easily install and replace production flowlines, hydraulic control lines and the like.

Though various forms of underwater flowline and related connectors have been proposed for offshore and the like well installations, no truly satisfactory way has heretofore been found for remotely installing and replacing the flowlines necessary for production and for other subsea connections and functions. The fact that the flowline may be installed at depths ranging up to many thousands of feet requires that equipment be provided which can be installed and operated without diver assistance. Further, the relatively great depths contemplated for offshore installations, and the unpredictable and often extreme forces which may act on the equipment after installation, requires that all of the components, including those provided for such purposes as connecting flowlines and hydraulic control lines, be assembled and supported in such a manner as to be reliably and safely installed despite the often adverse conditions.

2. Discussion of the Prior Art

Hanes, et al. U.S. Pat. No. 3,710,859 discloses a flowline connector of the type in common usage in the prior art. The connector generally includes a looped flowline which ends with a connector at the end thereof being in a generally horizontal position. The connector is designed to remotely connect a flowline to subsea equipment such as submerged wellheads in deep water. In this arrangement the wellhead equipment is first installed in place, the flowline is next lowered from a floating vessel to a position adjacent the wellhead, and is then oriented to place the terminal portion of the flowline in alignment with the associated wellhead equipment, such as the pipes or loops of a Christmas tree assembly connected to the wellhead. After such alignment is secured, a connector and an actuating mechanism are lowered from the floating vessel to a position between the wellhead and the flowline, and the connector is placed in leakproof relation therebetween, with all operations being controlled from the floating vessel. After the connection is made, the runningin string can be released from the connector and raised to the floating vessel. In this horizontally completed connection, a female active component and a male passive component of the flowline connection generally have an overlap engagement of twelve to thirty inches, depending upon the size of the connector. In order to provide for relative movement between the female and male parts of the flowline connection, flexibility in the piping and/or movement of the flowline is necessary. The forces necessary to cause this relative movement between the female and male parts of the flowline connection are applied by large hydraulic cylinder(s) either mounted on the subsea equipment or in a connection tool deployed from a surface vessel.

SUMMARY OF THE INVENTION

Accordingly, it is a primary object of the present invention to provide a more efficient subsea flowline connector than the type of horizontal flowline connector now in common usage in the prior art.

A more general object of this invention is to provide underwater equipment which enables the operators to accomplish satisfactory and reliable installation of production flowlines and the like from a point remote from the installation.

A further object of the subject invention is the provision of a vertical type of flowline connector wherein the male and female portions of the connector can be properly positioned relative to each other by simply lowering the upper portion of the connector onto the lower portion thereof.

In accordance with the teachings herein, the present invention provides a subsea vertical connection to a subsea facility in which a lower portion of the connector is provided at the subsea facility with at least two vertically positioned, upwardly facing male mandrel fluid connectors. The upper portion of the connector assembly is designed to be lowered onto the lower portion thereof provided on the subsea facility, and at least two vertically positioned, downwardly facing corresponding female fluid connectors are designed to be lowered onto the corresponding male mandrel connectors.

One very important aspect of the present invention is that at least one of the female connectors is mounted on the connector assembly by a free floating mounting. The free floating mounting allows for slight misalignments of the female connectors relative to the corresponding male connectors as the upper connector assembly is lowered onto, and passively positioned relative to, the lower connector assembly. In one preferred embodiment, the free floating mounting includes rubber bushings or mounts to provide the free floating function. Each of the individual connections includes a hydraulically actuated locking mechanism which is actuated after the male and female connectors are properly positioned relative to each other. A flexible connector pipe is also provided extending from the connector assembly to each free floating female connector, and in one disclosed embodiment includes a looped connector hose. Each floatingly mounted female connector is also provided with radial positioning ribs to assist in guiding the female connector into a proper position with respect to the corresponding male mandrel connector as the connector assembly is lowered into place.

In one disclosed embodiment of the present invention, a flowline extends from the subsea facility along the subsea bottom and terminates at the subsea facility in a bullnose connector which is drawn, with the attached flowline, by a draw line into a given position on the subsea facility in which a male mandrel connector provided on the bullnose connector is vertically oriented to become one of the male mandrel connectors on the subsea facility.

In one disclosed embodiment of the invention, one pair of centrally positioned male and female fluid connectors are provided, with the central female connector being rigidly secured to the connector assembly. At least one additional pair of radially positioned corresponding male and female connectors is coupled to the flowline, with the radially positioned female connector being mounted in a free floating mounting. In an alternative embodiment, a central connection is provided for mechanical alignment and latching functions only, and two pairs of radially positioned corresponding male and female fluid connectors are provided, with each radially positioned female connector being mounted in a free floating mounting.

BRIEF DESCRIPTION OF THE DRAWINGS

The foregoing objects and advantages of the present invention for a vertical flowline connector may be more readily understood by one skilled in the art with reference being had to the following detailed description of several preferred embodiments thereof, taken in conjunction with the accompanying drawings wherein like elements are designated by identical reference numerals throughout the several views, and in which.

DETAILED DESCRIPTION OF THE DRAWINGS

Figure 1:
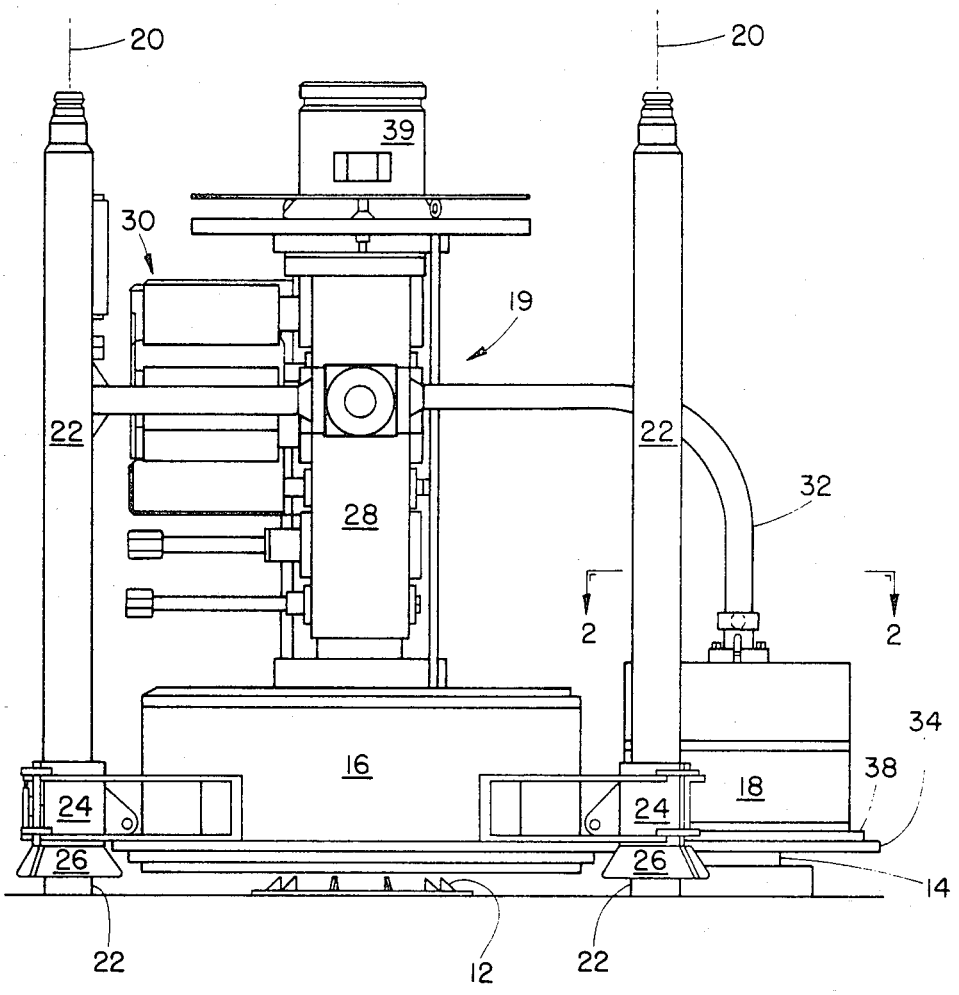
FIG. 1 is an elevational view of a first exemplary embodiment of the present invention for a subsea vertical flowline connection to a satellite well utilizing a tree type of connector.

Referring to the drawings in detail, FIG. 1 illustrates an exemplary embodiment of a completed vertical flowline connection pursuant to the present invention which includes a centrally and vertically positioned, upward facing wellhead male mandrel 12 and a radially and vertically positioned, upward facing flowline male mandrel 14 for connection to a flowline extending to a further subsea facility. The central male mandrel connector 12 forms a connection with a centrally and vertically positioned, downward facing female wellhead connector 16, while the radially positioned male mandrel connector 14 forms a connection with a corresponding radially positioned, downward facing female connector 18. The interconnecting link between the subsea facility or well and the flowline is in the form of a subsea Christmas tree and frame assembly 19 which mounts the downward facing female connectors.

The frame assembly 19 can be lowered to the subsea bottom on guide lines or cables 20 which are connected at their lower ends to guide tubes 22 positioned around the wellhead. The tree assembly 19 includes correspondingly positioned guide sleeves 24 with outwardly flared guide bottoms 26. In this arrangement, the Christmas tree and frame assembly is normally lowered by a pipe (not shown), while the guide sleeves 26 slide down the guide cables 20 and then are guided by the flared bottoms onto and over the guide tubes 22 to properly position the frame assembly and downwardly facing female connectors 16 and 18 relative to the upwardly facing male mandrel connectors 12 and 14 until the male and female connectors are properly positioned in overlapping relationship.

The male and female connectors 12, 14, 16 and 18 can be commercially available male and female interlocking connectors which, after proper positioning thereof, can be locked in place by a hydraulically actuated locking mechanism. Preferably the connectors should have a positive lock, positive unlock mechanism with a lock indicator and a mechanical release over-ride. The embodiment of FIG. 1 includes a typical Christmas tree type of valve and pipe arrangement with a central valve body 28 and valve actuators 30, and a flexible flowline 32 extends from stem 28 to the radially positioned, downward facing female connector 18. The top of the Christmas tree assembly 19 includes a further coupling, under a removable protective cover 39, for coupling to a riser pipe, not shown, during an installation operation.

One very important aspect of the present invention is that the radially located female connector 18 is mounted in a free floating mounting relative to the centrally located female connector 16 to allow for slight misalignments of the corresponding male and female connectors as the Christmas tree and frame assembly 19 is lowered onto the corresponding structure on the subsea facility. The frame assembly includes a lower frame plate 34, relative to which the central female connector 16 is substantially fixed and rigidly mounted. The lower frame plate 34 defines a circular aperture 36 in which the radially located female connector is floatingly mounted. For example, the free floating mounting can include a large rubber bushing 38 extending completely around the connector 18 and mounted loosely in and over the circular aperture 36 between the connector 18 and the base plate 34, such that the connector 18 is relatively freely movable within the confines of the circular cutout 36 within the elastic limitations of the rubber bushing 38.

Figure 3:
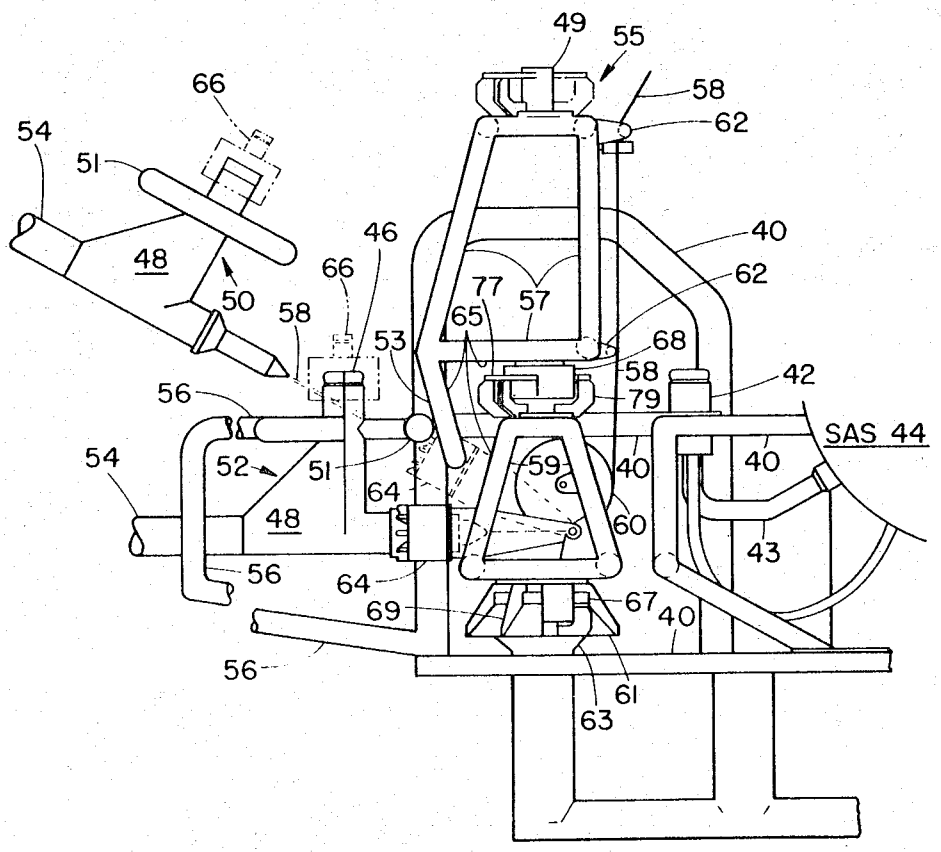
FIG. 3 illustrates the operation of a flowline drawdown arrangement to a subsea atmospheric system having a drawdown tool temporarily located thereon, which results in a vertical orientation of a male flowline mandrel connector on the end of the flowline.
Figure 2:
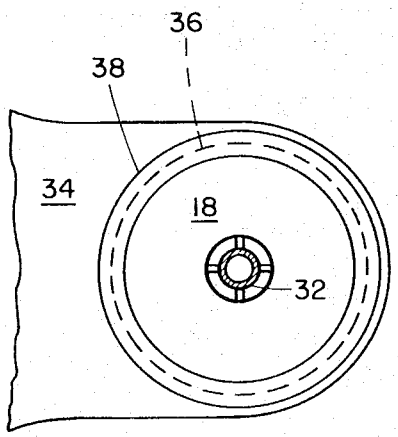
FIG. 2 is a view in the direction of arrows 2—2 in FIG. 1, and illustrates a free floating mounting of the vertical flowline connector.

FIG. 3 illustrates the operation of a flowline pull in or drawdown arrangement to a Subsea Atmospheric System (SAS) which includes an external frame 40 attached to SAS structure 44. An upward facing, vertically positioned male mandrel connector 42 is mounted on the frame 40 to provide a fluid connection by pipe 43 into the SAS assembly 44. A second upward facing, vertically positioned male mandrel connector 46 is provided on a bullnose drawdown connector 48 which is shown in two positions in FIG. 3, an approach position 50, and a final deployed position 52. The bullnose drawdown assembly 48 is provided at one end of a flowline 54 which, in its final deployed position rests on the sea bottom. The flowline 54 is normally a flowline bundle having a number of separate pipes or tubes therein extending to a satellite production well or to another SAS facility, or to a Subsea Atmospheric Riser Manifold (SARM) facility. During the initial deployment of the flowline 54, the flowline can be made buoyant by strapping synthetic foam modules thereto periodically along the line 54. Spar buoys of solid syntactic foam can also be attached directly to the flowline, rather than by tether lines, to provide positive buoyancy therefor, and the spar buoys can be remotely released as by acoustically triggered explosive bolts. Alternatively, flooding of the flowline can be utilized to add bottom weight.

During the flowline 54 pull-in and laydown operations, an upward looking V frame 56 is provided on the subsea facility to guide the bullnose drawdown assembly 48 into its final deployed position 52. Moreover, the bullnose assembly is also provided with a bumper frame 51 which contacts against a corresponding frame bumper portion 53 of a drawdown tool 55 which is temporarily deployed onto the subsea frame structure 40 for the drawdown operation. The drawdown tool 55 includes an upper frame 57 and a lower frame 59, shown as a somewhat bell shaped structure in FIG. 3.

The embodiment of FIG. 3 illustrates structure for installing the drawdown tool 55 using guidelineless techniques (without guidelines 20 and associated guideline structure 22, 24, 26). The guidelineless installation equipment includes an upper mounting 49 on top of the upper frame 57 for connection to a pipe, not shown, for lowering the drawdown tool 55 onto the subsea frame structure 40. The lowering operation can be guided and aligned by remote television and/or sonar equipment and by a bumper guide frame system. The drawdown tool 55 includes an inverted funnel shaped guide member 61 reinforced by ribs 69 and attached below the lower frame 59. A downward facing female connector 67 is positioned within the guide member 61 for attachment to a corresponding upward facing male mandrel wellhead connector 63, after guide member 61 assists in aligning the two connectors. The male and female connectors can be hydraulically actuated and locked, similar to the flowline connectors, but are provided only for aligning and mechanically latching the drawdown tool to the subsea structure for the drawdown operation.

A flowline hub protector cap 66 can be employed to cover and protect the male mandrel connector 46 during the deployment operation. A drawdown line 58 is attached to the nose of the bullnose assembly 48 and extends around a pulley 60 on the drawdown tool and through additional guides 62 also provided thereon to a surface vessel having a traction winch pull-in and powered storage reel. The bullnose assembly is pulled, along with the buoyant flowline 54, into a position, with the assistance of the upward V shaped guide structure 56, into a bullnose receptacle 64, through which the drawdown line 58 extends, and which is pivoted about a generally horizontal axis in a pivot member attached to the subsea facility. During the intial deployment, the bullnose receptacle points upwardly in the direction of the buoyed flowline 54, as indicated in dashed lines. However, in the final deployed position with the flowline on the sea floor, the bullnose receptacle 64 and the bullnose assembly 48 are positioned horizontally, as indicated by the solid line position, with the male mandrel connector 46 looking upwardly in a vertical position. The upward facing V shaped guide structure 56 can also be configured to assist in the vertical positioning of the male mandrel connector 46 as the bullnose connector is drawn by the drawdown line 58 into its final deployed position. The bullnose assembly 48 and the bullnose receptacle 64 are preferably equipped with a spring loaded dog to lock those components to each other after the bullnose assembly 48 is properly positioned in its receptacle 64.

After the bullnose assembly is properly latched into the receptacle 64 and positioned in its final deployed position, the drawdown tool 55 is released, by any conventional technique, from the connection to the male mandrel 63, after which the tool can be removed and raised to the surface.

Figure 4:
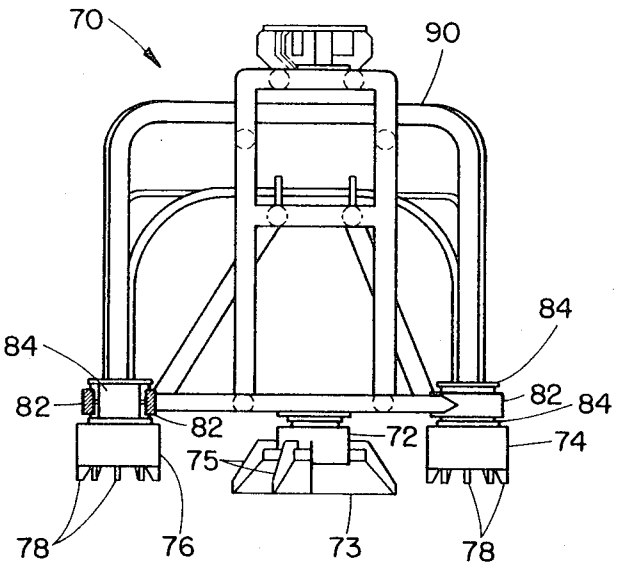
FIG. 4 illustrates a jumper frame having downwardly oriented female connectors which is designed to be lowered downwardly onto the upwardly facing connector arrangement of FIG. 3.

A centrally positioned, upwardly facing male mandrel connector 68 is also provided on the frame structure 40 of FIG. 3. FIG. 4 illustrates an inverted U shaped jumper frame 70 which is designed to be lowered downwardly onto the upwardly facing connector arrangement of FIG. 3 after removal of the drawdown tool The jumper assembly 70 includes a centrally positioned, downwardly facing female connector 72 designed to be lowered downwardly onto, and to be subsequently locked with respect to, the corresponding central male mandrel connector 68. The female connector 72 includes a downwardly facing funnel-shaped guide member 73 having radially positioned reinforcing ribs 75 thereon. The guide member 73 interacts with an annular plate 77 positioned around the male mandrel connector 68 by supporting ribs 79 to initially align the female connector 72 relative to the male mandrel connector 68 as the jumper assembly 70 is lowered onto the subsea structure during a deployment operation. The male and female connectors 68, 72 are provided for mechanical alignment and latching only and do not serve as a fluid connection, although they can be substantially the same as flowline connectors and be hydraulically actuated and locked. Guide structure similar to annular plate 77 and supporting ribs 79 would also be provided on male mandrel connector 68, but is covered in the drawing of FIG. 3.

Two radially located downward facing female connectors 74, 76 are also provided on the jumper assembly 70, are designed to be lowered downwardly onto, and to be subsequently sealed with respect to, the corresponding radially positioned male mandrel connectors 42, 46.

Each of the female connectors 74, 76 includes radially oriented positioning ribs 78, which are also sloped radially upwardly towards the center of the connectors. The positioning ribs 78 serve to guide the female connector into a proper position with respect to its corresponding male connector as the connector jumper assembly 70 is lowered onto the subsea facility. Moreover, each radially positioned female connector 74, 76 is mounted in a free floating mounting, which can be similar in structure to the free floating mounting provided for connector 18 in the first embodiment described herein. In the illustrated embodiment, the female connectors 74, 76 are flexibly and free floatingly mounted in a surrounding collar 82 which is rigidly secured to the frame of the jumper assembly 70. A large rubber bushing or grommet 84 is mounted within the collar 82 and around the flowline 90 and upper portion of female connector 74 to provide a flexible, free floating mounting for the female connector 74. The free floating mounting for female connector 76 is shown partially in section to illustrate further details of the design of this embodiment.

The free floating mountings for female connectors 74 and 76 allow for slight misalignments of the female connectors relative to the corresponding male mandrels 42, 46 as the jumper assembly 70 is lowered onto the SAS bottom structure of FIG. 3. The U shaped flowline 90 interconnecting the two female connectors also provides flexible mountings therefor to allow for movements to accommodate the slight misalignments. Each of the male connectors 42, 46, 63 and 68 and the corresponding female connectors 74, 76, 67 and 72 can be commercially available connectors sized in accordance with their flow and/or mechanical requirements and provided with a hydraulically actuated positive lock-positive unlock locking mechanism with a lock indicator and a mechanical release over-ride.

In overall result, this embodiment of the present invention provides an interconnection between a flowline 54 and the SAS facility 44 which extends from the flowline 54, through couplings 46, 76, through U shaped flowline 90, through couplings 42, 74, and then through flowline 43 extending into the SAS facility 44. In alternative embodiments, an interconnection could be established between a flowline and a SARM base or a platform base in very deep water or any other suitable facility.

Figure 5:
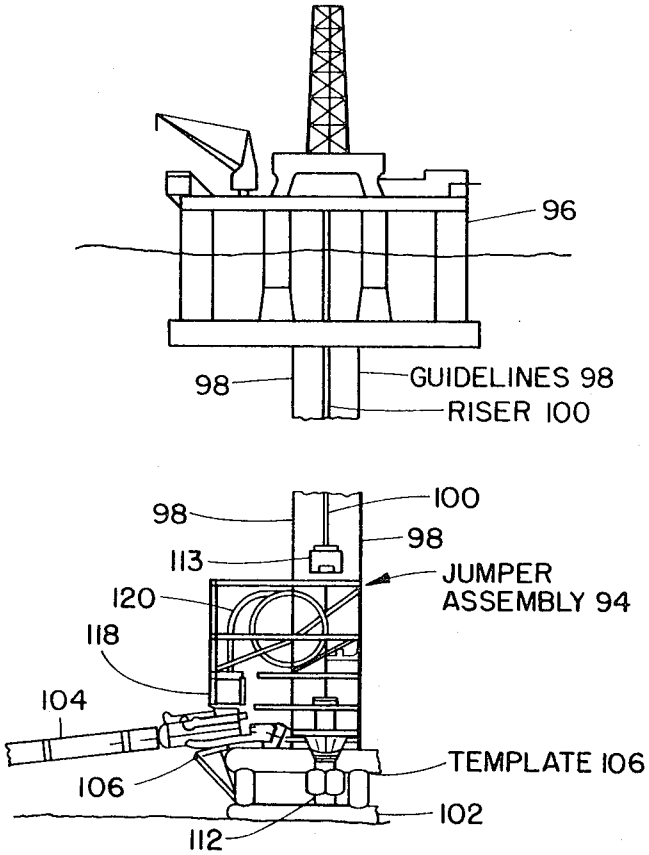
FIG. 5 is a schematic illustration of another embodiment of a subsea, vertical flowline connection in a completed state.
Figure 6:
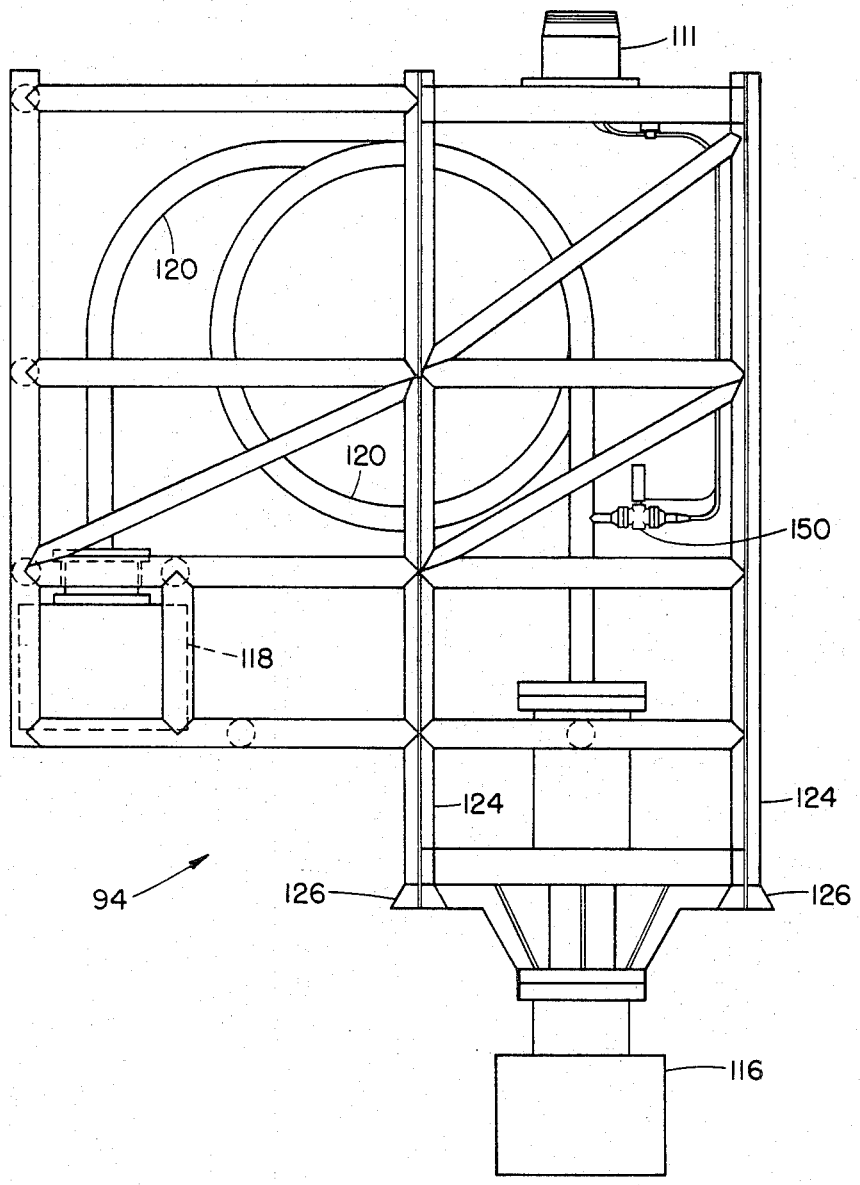
FIG. 6 is an enlarged elevational view of only the jumper assembly of FIG. 5.
Figure 7:
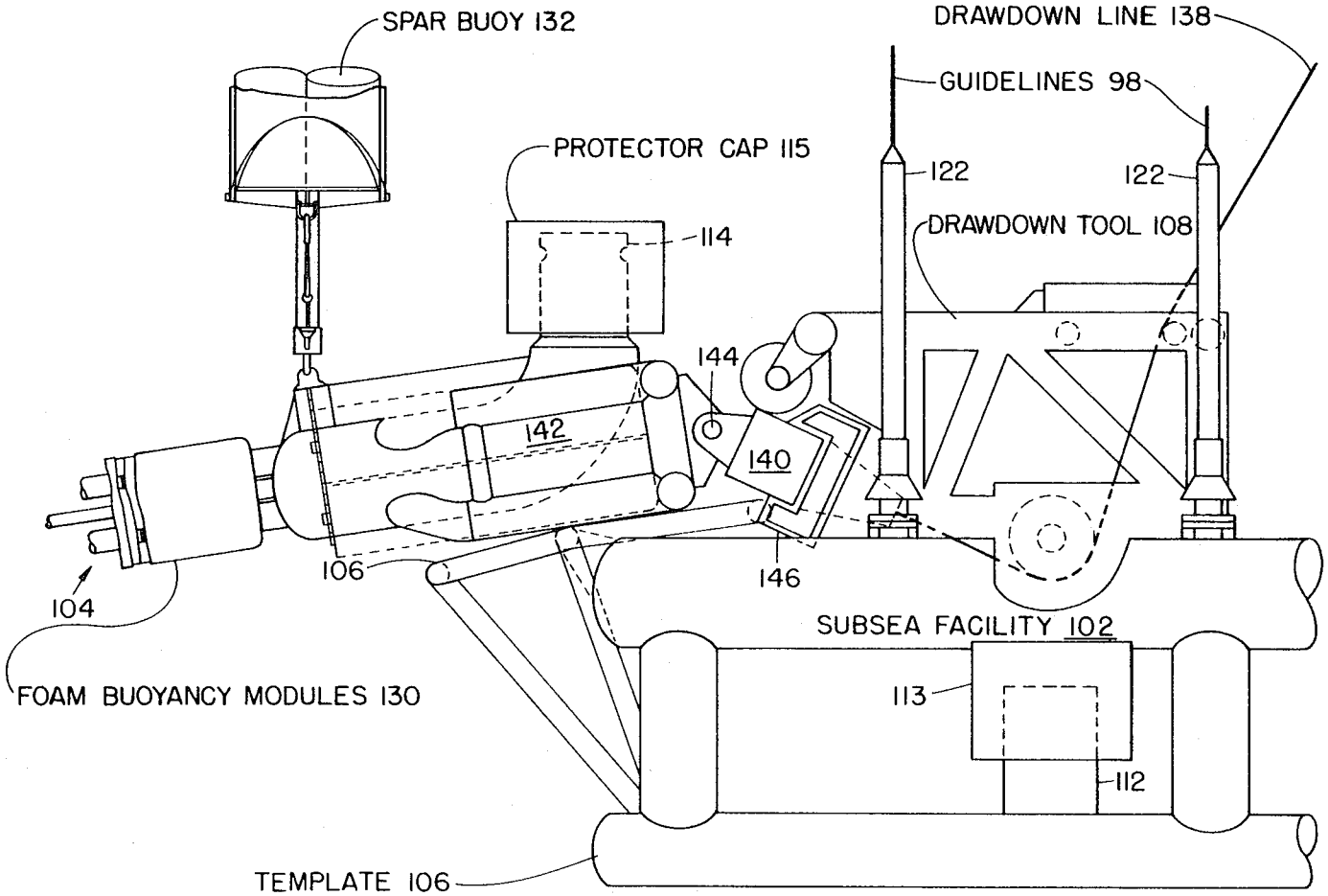
FIG. 7 illustrates an enlarged elevational view of the subsea facility of FIG. 5 having a drawdown tool temporarily located thereon to assist in the drawdown of the flowline.

FIG. 5 is a schematic illustration of another embodiment of a subsea vertical flowline connection in a completed state, while FIG. 6 shows an enlarged view of just the jumper assembly 94 shown in FIG. 5, and FIG. 7 is an enlarged view of just the subsea facility after completion of a drawdown operation. In this embodiment, a semisubmersible rig 96 is provided near the sea surface. Guidelines 98 and a riser 100 extend between the semisubmersible 96 and a subsea facility 102. A horizontal flowline 104 extends from the subsea facility 102 along the sea bottom, and is joined by a fluid coupling established through the jumper assembly 94 to the subsea facility 102. The subsea facility 102 includes a template arrangement 106 (typically for an SAS or SARM) on which either a drawdown tool 108 or the corresponding jumper assembly 94 is mounted.

This embodiment includes a somewhat centrally and vertically positioned, upward facing wellhead male mandrel flow connector 112 and a radially and vertically positioned, upward facing flowline male mandrel connector 114 for connection to the flowline 104 extending from the subsea facility 102 to a further subsea facility such as a satellite well. The male mandrel connectors 112, 114 can initially have protector caps 113, 115 mounted thereon. The central male mandrel connector 112 forms a connection with a centrally and vertically positioned, downward facing female wellhead connector 116, while the radially positioned male mandrel connector 114 forms a connection with a corresponding radially positioned, downward facing female connector 118. The interconnecting link between the subsea facility or well and the flowline 104 is in the form of a looped flowline 120.

The jumper assembly 94 can be guided to the subsea bottom on the guidelines 98 which are connected at their lower ends to guide tubes 122 positioned by the template 106. The jumper assembly 94 includes correspondingly positioned guide sleeves 124 with outwardly flared guide bottoms 126. In this arrangement, the jumper assembly 94 is lowered by the riser 110 while the guide sleeves 126 slide down the guide cables 98 and then are guided by the flared bottoms onto and over the guide tubes 122 to properly position the jumper assembly 94 and downwardly facing female connectors 116 and 118 relative to the upwardly facing male mandrel connectors 112 and 114 until the male and female connectors are properly positioned in overlapping relationship.

The male and female connectors 112, 114, 116 and 118 can be commercially available male and female interlocking connectors as described above. The radially located female connector 118 is mounted in a free floating mounting, similar to those described above, which in combination with looped flowline 120 allows for slight misalignments of the corresponding male and female connectors as the jumper assembly 94 is lowered onto the corresponding structure on the subsea facility.

During the initial deployment of the flowline 104, the flowline can be made buoyant by strapping synthetic foam modules 130 thereto periodically along the line 104. Spar buoys 132 of solid syntactic foam can also be attached directly to the flowline, rather than by tether lines, to provide positive buoyancy therefor, and the spar buoys can be remotely released as by acoustically triggered explosive bolts. Alternatively, flooding of the flowline can be utilized to add bottom weight.

During the initial stages of the deployment, the drawdown tool 108 is lowered down the guidelines 98 to the position illustrated in FIG. 7, in which it is latched in a manner similar to the embodiment of FIGS. 3 and 4. A drawdown line 138, attached to a drawdown connector 140, 142, is then power winched to draw the buoyed flowline 104 into the position of FIG. 7. The connector 140, 142 is pivoted about connection point 144 during the drawdown operation. The forward connector portion 140 is provided with a square cross sectional shape to be properly positioned within a correspondingly shaped connector receptacle 146, through which the drawdown line 138 extends, and which is suitably pivotally attached to the subsea facility 102. The connector 140 and the connector receptacle 146 are preferably equipped with a spring loaded dog to lock those components to each other after the connector 140 is properly positioned in the receptacle 146.

After the connector 140 is properly latched into the receptacle 146 and positioned in its final deployed position, the drawdown tool 108 is released, by any conventional technique, after which the tool can be removed and raised to the surface. In the final deployed position of connector 142, the male mandrel 114 is positioned substantially vertically in the upward looking position of FIG. 7. The jumper assembly 94 is next lowered by the riser 100 and guidelines 98 into the position of FIG. 5. Each line of the jumper assembly 94 can be provided with a flowline test valve 150.

While several embodiments and variations of the present invention for a vertical flowline connector are described in detail herein, it should be apparent that the disclosure and teachings of the present invention will suggest many alternative designs to those skilled in the art.

What is claimed is:

1. Apparatus for establishing a flowline connection from a subsea facility to a flowline extending therefrom, comprising:

a. a subsea facility including at least two vertically positioned, upwardly facing male mandrel connectors;

b. a flowline extending from said subsea facility onto the adjacent subsea bottom, said flowline terminating at said subsea facility in one of said upwardly facing male mandrel connectors;

c. a connector assembly designed to be lowered onto the subsea facility, including at least two vertically positioned, downwardly facing male connectors designed to be lowered onto the at least two upwardly facing male mandrel connectors, with at least one downwardly facing female connector being mounted to the connector assemble by a free floating mounting, said free floating mounting including a bushing loosely mounted to said female connector to allow for slight misalignments of the female connectors on the connector assembly relative to the male connectors on the subsea facility as the connector assembly is lowered onto the subsea facility, said connector assembly including a flowline, also providing flexibility for said free floating mounting, joining said at least two male and corresponding female connectors to establish a flowline communication from said flowline, through said connector assembly, to the further subsea facility.

2. A subsea vertical flowline connection to a subsea facility as claimed in claim 1, said free floating mounting including rubber bushings or mounts extending completely around said female connector and within an aperture in a lower base plate of said connector assembly mounted intermediate said female and male connectors to provide the free floating function.

3. A subsea vertical flowline connection to a subsea facility as claimed in claim 1, each coupled male and female connector including a hydraulically actuated locking mechanism which is actuated after the male and female connectors are properly positioned relative to each other.

4. A subsea vertical flowline connection to a subsea facility as claimed in claim 3, including a flexible connector extending from the connector assembly to at least one female connector.

5. A subsea vertical flowline connection to a subsea facility as claimed in claim 4, said flexible connector comprising a looped connector hose.

6. A subsea vertical flowline connection to a subsea facility as claimed in claim 1, each free floating female connector including radially oriented positioning ribs to guide the female connector into a proper position with respect to each male mandrel connector as the connector assembly is lowered onto the subsea facility.

7. A subsea vertical flowline connection to a subsea facility as claimed in claim 1, said flowline terminating at the subsea facility in a drawing connector which is drawn, with the attached flowline, by a drawdown line into a proper position on the subsea facility in which the drawing connector is attached to the subsea facility, and said drawing connector includes a vertically positioned, upwardly facing male mandrel connector which comprises one of the upwardly facing male mandrel connectors on the subsea facility.

8. A subsea vertical flowline connection to a subsea facility as claimed in claim 1, said corresponding male and female connectors including one pair of centrally positioned, male and female corresponding connectors, with the central female connector being rigidly secured to said connector assembly, and at least one pair of radially positioned corresponding male and female connectors to which said flowline is coupled, said at least one radially positioned female connector being mounted to the connector assembly by said free floating mounting.

9. A subsea vertical flowline connection to a subsea facility as claimed in claim 1, said corresponding male and female connectors including two pairs of radially positioned corresponding male and female connectors, with each radially positioned female connector being mounted to the connector assembly by a free floating mounting.

10. A subsea vertical flowline connection to a subsea facility as claimed claim 9, said free floating mounting including rubber bushings or mounts extending completely around said female connector and within an aperture in a lower base plate of said connector assembly mounted intermediate said female and male connectors to provide the free floating function.

11. A subsea vertical flowline connection to a subsea facility as claimed in claim 9, said free floating mounting including rubber bushings or mounts extending around said female connector and within a collar rigidly secured to said connector assembly to provide the free floating function.

12. A subsea vertical flowline connection to a subsea facility as claimed in claim 11, each coupled male and female connector including a hydraulically actuated locking mechanism which is actuated after the male and female connectors are properly positioned relative to each other.

13. A subsea vertical flowline connection to a subsea facility as claimed in claim 12, including a flexible connector extending from the connector assembly to each radially located female connector.

14. A subsea vertical flowline connection to a subsea facility as claimed in claim 13, said flexible connector comprising a looped connector hose.

15. A subsea vertical flowline connection to a subsea facility as claimed in claim 14, each downwardly facing female connector including radially oriented positioning ribs to guide the female connector into a proper position with respect to each male mandrel connector as the connector assembly is lowered onto the subsea facility.

16. A subsea vertical flowline connection to a subsea facility as claimed in claim 15, said flowline terminating at the subsea facility in a drawdown connector which is drawn, with the attached flowline, by a drawdown line into a proper position on the subsea facility in which the drawdown connector is attached to the subsea facility, and said drawdown connector including a vertically positioned, upwardly facing male mandrel connector which comprises one of the upwardly facing male mandrel connectors on the subsea facility.

* * * * *